US007061357B2

(12) United States Patent
Lee et al.

(10) Patent No.: US 7,061,357 B2
(45) Date of Patent: Jun. 13, 2006

(54) HIGH VOLTAGE TRANSFORMER AND MICROWAVE OVEN PROVIDED WITH THE SAME

(75) Inventors: Kil Young Lee, Suwon (KR); Tae Kyou Park, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 11 days.

(21) Appl. No.: 10/753,482

(22) Filed: Jan. 9, 2004

(65) Prior Publication Data

US 2004/0222872 A1 Nov. 11, 2004

(30) Foreign Application Priority Data

May 7, 2003 (KR) ..... 10-2003-0029107

(51) Int. Cl.
*H01F 27/30* (2006.01)

(52) U.S. Cl. ..... 336/198

(58) Field of Classification Search ..... 336/55–60, 336/65, 83, 90, 198, 200, 206–208, 192; 219/760

See application file for complete search history.

(56) References Cited

U.S. PATENT DOCUMENTS

| | | | | |
|---|---|---|---|---|
| 4,027,279 | A * | 5/1977 | Shigehara | 336/90 |
| 4,804,340 | A * | 2/1989 | Hamer et al. | 439/709 |
| 4,812,798 | A * | 3/1989 | Chappel | 336/98 |
| 4,885,445 | A * | 12/1989 | Taniguchi | 219/760 |
| 5,954,988 | A * | 9/1999 | Lee | 219/757 |
| 5,973,307 | A * | 10/1999 | Cho | 219/760 |
| 6,185,811 | B1 * | 2/2001 | Perry | 29/606 |
| 6,414,291 | B1 * | 7/2002 | Kim | 219/760 |
| 6,646,531 | B1 * | 11/2003 | Kim | 336/90 |

OTHER PUBLICATIONS

Patent Abstracts of Japan, Taniguchi Hisaya, Stepup Transformer for Microwave Oven, 01-154488, dated Jun. 16, 1989.

* cited by examiner

*Primary Examiner*—Tuyen T Nguyen
(74) *Attorney, Agent, or Firm*—Staas & Halsey LLP

(57) ABSTRACT

A high voltage transformer includes a core, an output terminal, and an insulation member. The core is surrounded by coils to boost an alternating current voltage, and is grounded. The output terminal outputs the voltage boosted by the plurality of coils. The insulation member is disposed between the output terminal and the core.

11 Claims, 4 Drawing Sheets

HIGH VOLTAGE TRANSFORMER AND MICROWAVE OVEN PROVIDED WITH THE SAME

CROSS-REFERENCE TO RELATED APPLICATION

This application claims the benefit of Korean Patent Application No. 2003-29107, filed May 7, 2003 in the Korean Intellectual Property Office, the disclosure of which is incorporated herein by reference.

BACKGROUND OF THE INVENTION

1. Field of the Invention

The present invention relates to a high voltage transformer and microwave oven provided with the same, which allows an insulation distance between the output terminals of a secondary coil and a core to be extended, thereby improving an insulating effect.

2. Description of the Related Art

A high voltage transformer is a device that serves to boost an input voltage supplied from an external power supply to a high voltage and output the boosted voltage, and is generally used in electronic products, such as a microwave oven.

The high voltage transformer used in a microwave oven is manufactured by joining a laminated E core containing E iron cores, with a laminated I core containing I iron cores. Electrical parts, such as a primary coil, a secondary coil, pass cores and a heater coil, are disposed between the laminated E core and the laminated I core. The electrical parts are insulated by surrounding them with insulating papers such as NOMEX papers.

The high voltage transformer includes output terminals to output a boosted voltage. The output terminals are electrically connected to the secondary coil. The microwave oven, to which the high voltage transformer is applied, includes a high voltage circuit unit that applies a driving voltage to a magnetron. The output terminals of the high voltage transformer are electrically connected to the high voltage circuit unit such that the output terminals of the high voltage transformer serve as a connecter that supplies the boosted voltage to the high voltage circuit unit.

A conventional high voltage transformer is manufactured by assembling electrical parts, insulating the electrical parts, such as the primary and second coils, by surrounding them with insulating papers, and performing an infiltration process of soaking the assembled electrical parts in varnish liquid.

The output terminals of the high voltage transformer are mounted on a terminal support made of insulating papers because the terminals output a high voltage, and the output terminals are spaced apart from a grounded core by a certain distance.

In order to ensure a sufficient insulation performance, international standards organizations require that an insulation distance is extended between each of the output terminals of the high voltage transformer and the core. That is, the international standard organizations set a distance to be extended between each of the output terminals of the high voltage transformer and the core. To satisfy the requirement imposed by the international standards organizations, the thickness of the terminal support to fix the output terminals is allowed to be thick and, therefore, the output terminals are spaced apart from the core. However, if the terminal support formed by the insulating paper is excessively thick, it is difficult to fix the terminal support to the second coil and to fix the output terminals to the terminal support, so that assembly time is lengthened and the output terminals may be extended out of the high voltage transformer. Accordingly, the total size of the high voltage transformer is increased, so that the high voltage transformer occupies an excessive space in a microwave oven when the high voltage transformer is mounted in the microwave oven and, therefore, miniaturization of a product is hindered.

SUMMARY OF THE INVENTION

Accordingly, it is an aspect of the present invention to provide a high voltage transformer and microwave oven provided with the same, which allows an insulation distance to be extended between the output terminals of a secondary coil and a core, thereby improving an insulating effect.

Another aspect of the present invention is to provide a high voltage transformer and a microwave oven provided with the same, which improves an insulating effect and simultaneously prevents the total size of the high voltage transformer from being increased, thereby enabling miniaturization of the high voltage transformer.

Additional aspects and advantages of the invention will be set forth in part in the description which follows and, in part, will be obvious from the description, or may be learned by practice of the invention.

The foregoing and/or other aspects of the present invention are achieved by providing a high voltage transformer, including a core that is surrounded by coils to boost an alternating current voltage and that is grounded, output terminals that output the voltage boosted by the coils, and an insulation member that is disposed between the output terminals and the core.

The output terminals are connected to a secondary coil when the coils include a primary coil and the secondary coil that are connected to a low voltage side and a high voltage side, respectively.

The insulation member allows an insulation distance to be extended between each of the output terminals and the core.

The insulation distance includes a roundabout distance extending from each of the terminals to the core in a roundabout manner, the roundabout distance being greater than a straight-line distance between each of the terminals and the core.

The insulation member is fabricated in a form of a plate.

The insulation member is vertically positioned.

The high voltage transformer further includes a terminal support that fixes the output terminals on the terminal support, in which the insulation member may be tightly interposed between the terminal support and the core.

The terminal support is made of an insulating paper.

The insulation member is made of a resin having an electrical insulation property and heat resistance.

The foregoing and/or other aspects of the present invention are achieved by providing a microwave oven, including a power supply that supplies an alternating current voltage, a high voltage transformer that boosts the alternating current voltage, and includes a core surrounded by a plurality of coils to boost the alternating current voltage and which is grounded, output terminals that output the voltage boosted by the plurality of coils, and an insulation member disposed between the output terminals and the core, a magnetron that generates microwaves, and a high voltage circuit unit that is electrically connected to a high voltage circuit, receives the voltage boosted by the high voltage transformer, and supplies a driving voltage to the magnetron.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
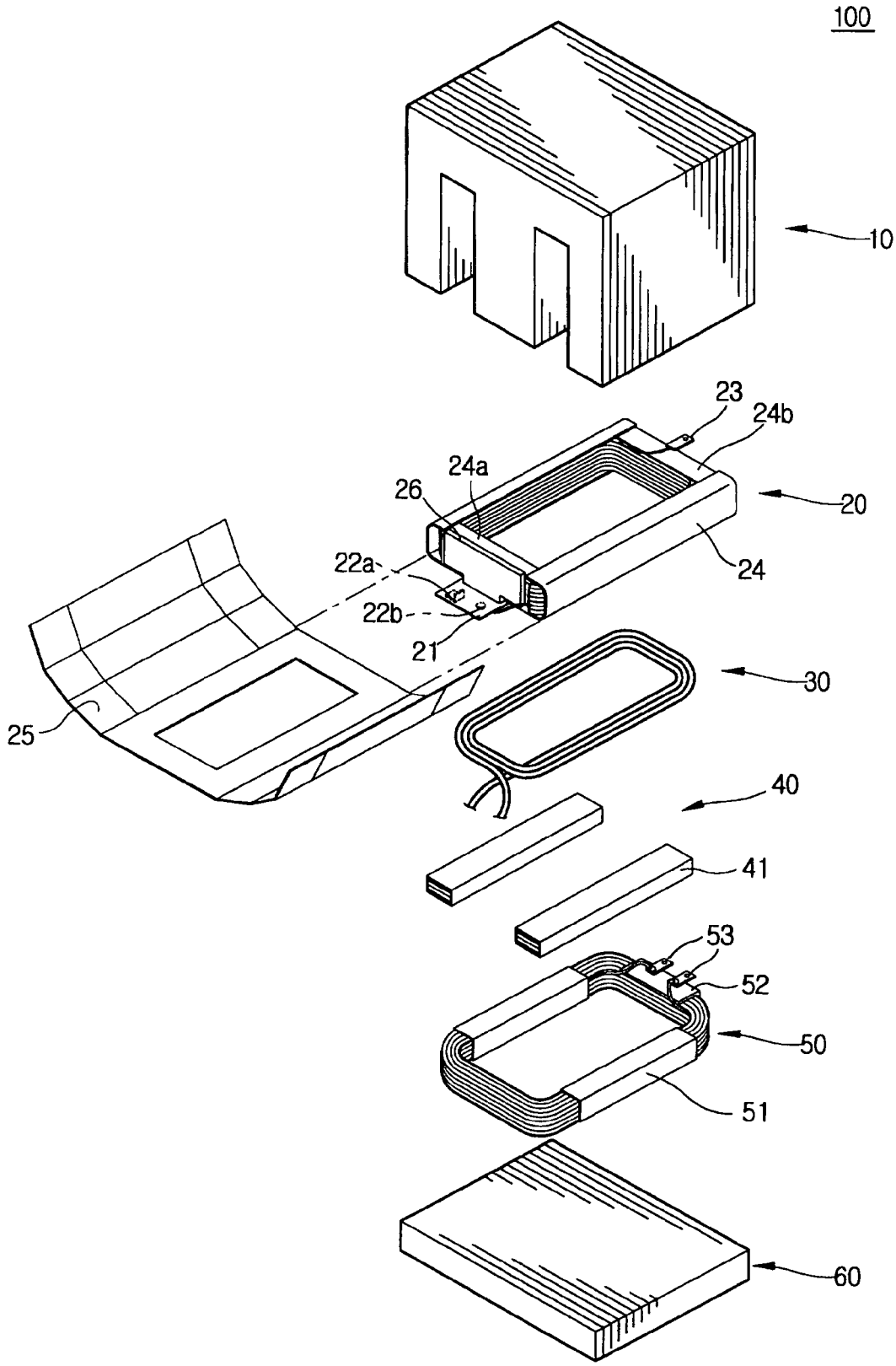
FIG. 1 is an exploded perspective view of a high voltage transformer, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is an exploded perspective view of a high voltage transformer, according to the present invention, which shows an example of the high voltage transformer applied to a microwave oven.

A high voltage transformer 100 of the present invention includes a laminated E core 10 and a laminated I core 60. The laminated E core 10 is formed by laminating a plurality of E iron cores, and the laminated I core 60 is formed by laminating a plurality of I iron cores.

Electrical parts, which are used to generate a high voltage and include a secondary coil 20, a heater coil 30, pass cores 40 and a primary coil 50, are disposed substantially between the laminated E core 10 and the laminated I core 60. Certain portions of the electrical parts, such as the output terminal 22*b* and the heater coil 30, protrude from the laminated E core 10 and the laminated I core 60.

Outside surfaces of the secondary coil 20 are surrounded by insulating papers 24, 24*a* and 24*b*. An output terminal 22*a* extended from the secondary coil 20 is fixed to a terminal support 21 made of an insulating paper, and a grounding terminal 23 extended from the secondary coil 20 is fixed to the insulating paper 24*b*. The output terminal 22*a* serves as a connector to output a boosted voltage. The grounding terminal 23 is fixed to the laminated E core 10.

Figure 2:
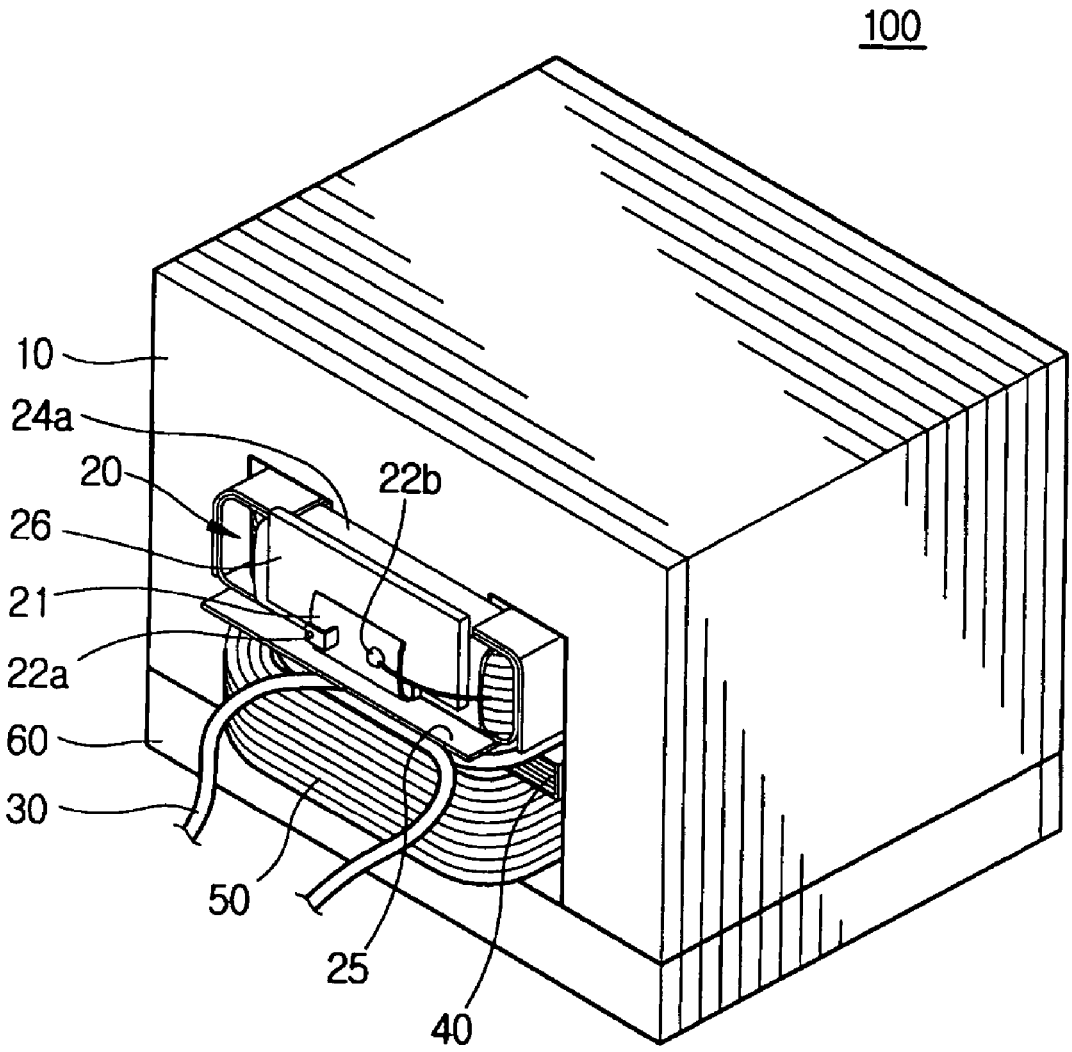
FIG. 2 is a perspective view of the high voltage transformer shown in FIG. 1, according to the present invention.

An insulation member 26 is positioned between the terminal support 21 and the insulating paper 24*a*, and fixed therebetween by an adhesive material. The insulation member 26 is made of resin having an electrical insulating property and heat resistance. An insulating paper 25 surrounds outside surfaces of the insulating papers 24, 24*a* and 24*b* to repeatedly surround the secondary coil 20, and is inserted between the secondary coil 20 and the heater coil 30. The insulating paper 25 is forwardly protruded to an outside of the high voltage transformer, compared to the terminal support 21, as shown in FIG. 2, so that a sufficient insulation distance between the laminated E core 10 positioned at the lower portion of the transformer and the output terminal 22*a* may be assured. The heater coil 30 is disposed below the insulating paper 25.

The pass cores 40 are disposed below the heater coil 30, and surrounded by insulating papers. The primary coil 50 is disposed below the pass cores 40, and lateral portions of the primary coil 50 are each surrounded by an insulating paper 51. Input terminals 53 are mounted on a terminal support 52 of the primary coil 50, and an alternating current voltage is input through the input terminals 53.

The insulation member 26 of the present invention is positioned between the terminal support 21 and the laminated E core 10. Referring to FIG. 2, the terminal support 21 is forwardly protruded from the secondary coil 20 inserted into the laminated E core 10 and vertically formed. The output terminal 22*a* of the secondary coil 20 is fixed to the terminal support 21. The insulation member 26 is fitted between the terminal support 21 and the secondary coil 20, and fixed therebetween by an adhesive material.

Figure 3:
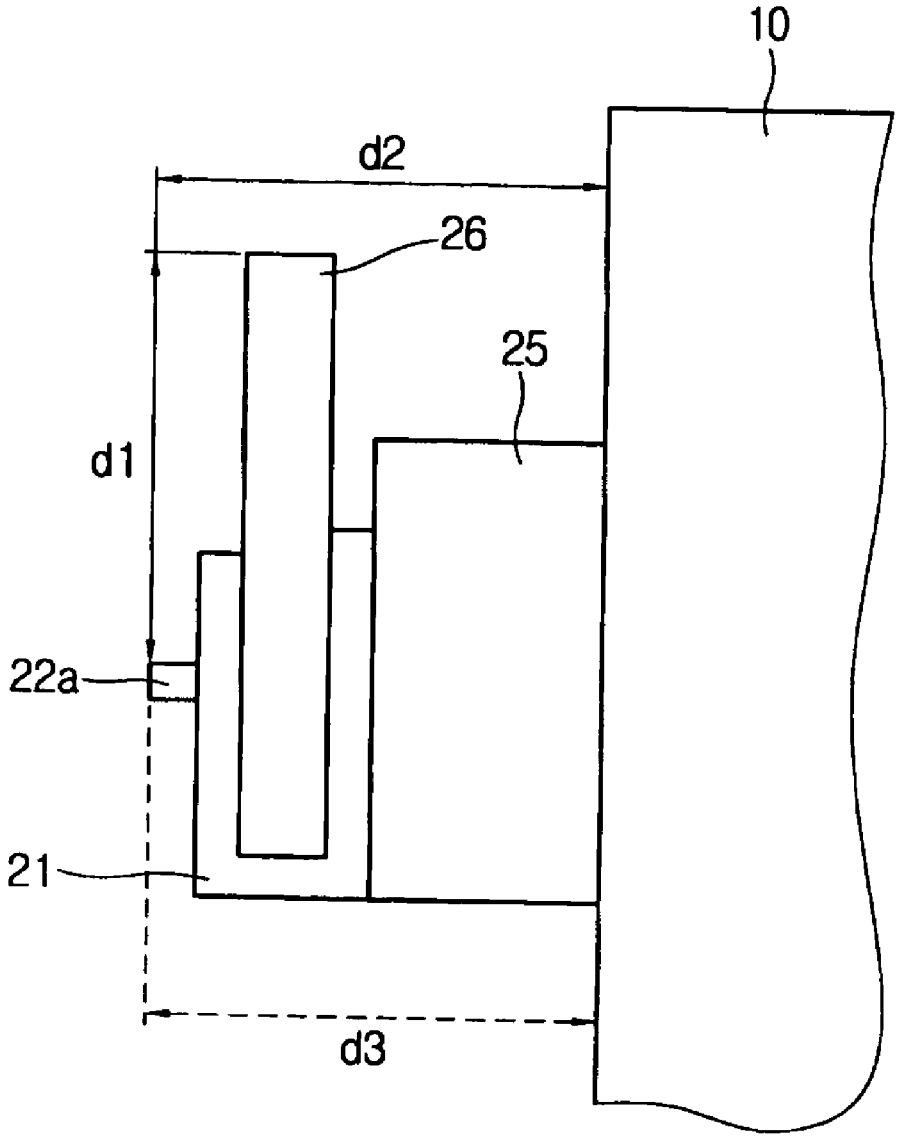
FIG. 3 is a sectional view illustrating an insulation distance in the high voltage transformer shown in FIG. 1, according to the present invention.

The insulation member 26 is fabricated in the form of a plate and vertically disposed to increase the insulation distance between the output terminal 22*a* and the laminated E core 10. In this case, the insulation distance is a roundabout distance d1+d2 (see FIG. 3) extending from the output terminal 22*a* to the laminated E core 10 in a roundabout manner. The roundabout distance d1+d2 is greater than a straight-line distance d3 between the output terminal 22*a* and the laminated E core 10.

As described above, the high voltage transformer 100 is equipped with the plate-shaped insulation member 26, so the insulation distance d1 +d2 between the output terminals 22*a* of the secondary coil 20 and the laminated E core 10 may be extended, and the insulation member 26 is easily mounted. Additionally, the insulation member 26 does not occupy a great space, so that the increase of the total size of the high voltage transformer may be prevented.

The high voltage transformer 100 may be applied to a microwave oven.

Figure 4:
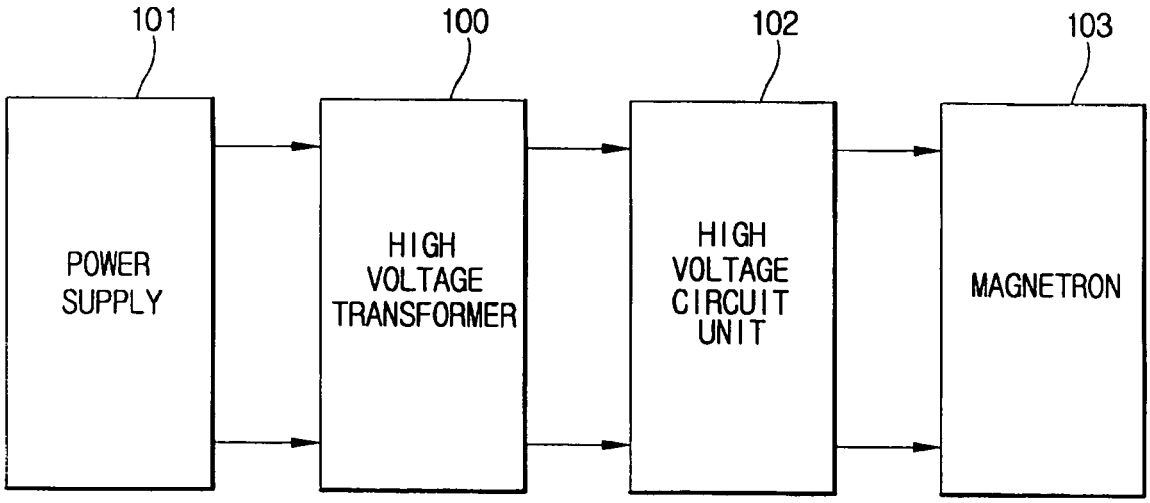
FIG. 4 is a circuit diagram of a microwave oven to which the high voltage transformer shown in FIG. 1 is applied, according to the present invention.

As shown in FIG. 4, the high voltage transformer 100 is electrically connected to a power supply 101 and a high voltage circuit unit 102. The high voltage transformer 100 receives an alternating current voltage from the power supply 101, and outputs a boosted high voltage based on a winding ratio of the primary and secondary coils 10 and 60 to the high voltage circuit unit 102 through the output terminal 22*a*. The high voltage circuit unit 102 applies a driving voltage to a magnetron 103 to generate microwaves. Accordingly, the magnetron 103 is driven and, therefore, food is heated to be cooked.

As described above, in the present invention, a plate-shaped insulation member is vertically mounted between an output terminal of a high voltage transformer and a laminated E core, so that an insulation distance between each of the output terminal of a secondary coil outputting a high voltage and the grounded laminated E core is extended.

Additionally, the insulation member does not occupy a great space and, therefore, the increase of the total size of the high voltage transformer may be prevented. Accordingly, a product may be miniaturized and an assembly process of the product becomes simple. Additionally, the high voltage transformer of the present invention is useful to be electrically connected to the high voltage circuit unit of a microwave oven.

Although a few embodiments of the present invention have been shown and described, the present invention is not limited to the described embodiments. Rather, it would be appreciated by those skilled in the art that changes may be made in this embodiment without departing from the principles and spirit of the invention, the scope of which is defined by the claims and their equivalents.

What is claimed is:

1. A high voltage transformer, comprising:

a core that is surrounded by a plurality of coils to boost an alternating current voltage, and that is grounded;

output terminals that output the voltage boosted by the plurality of coils; and an insulation member vertically positioned and fixed between the output terminals and the core at a predetermined distance away from the core such that the insulation member allows an insulation distance between the output terminals and the core to be extended, the insulation distance being a roundabout distance which is a total sum of a distance extending from the output terminals to a top of the insulation member and a straight-line distance between the output terminals and the core, the roundabout distance being greater than the straight-line distance between the output terminals and the core.

2. The high voltage transformer as set forth in claim 1, wherein the output terminals are connected to a secondary coil, and wherein the plurality of coils include a primary coil and the secondary coil connected to a low voltage side and a high voltage side of the high voltage transformer, respectively.

3. The high voltage transformer as set forth in claim 1, wherein the insulation member has a form of a plate.

4. The high voltage transformer as set forth in claim 1, wherein the insulation member is perpendicular to a winding direction of the plurality of coils.

5. The high voltage transformer as set forth in claim 1,further comprising a terminal support that fixes the output terminals thereon, wherein the insulation member is interposed between the terminal support and the core.

6. The high voltage transformer as set forth in claim 5, wherein the terminal support includes insulating paper.

7. The high voltage transformer as set forth in claim 1, wherein the insulation member includes a resin having properties of electrical insulation and heat resistance.

8. A high voltage transformer, comprising:

a core electrically connected to a potential;

a primary coil surrounding the core, the primary coil being connected to a low voltage portion of the high voltage transformer;

a secondary coil disposed near the primary coil, the secondary coil being connected to a high voltage portion of the high voltage transformer;

an insulating terminal support attached to the secondary coil;

an output terminal mounted on the insulating terminal support; and an insulation member vertically positioned and fixed between the secondary coil and the output terminal, wherein the insulation member effectively extends an electromagnetic distance between the output terminal and the secondary coil such that the electromagnetic distance is a roundabout distance which is a total sum of a distance extending from the output terminal to a top of the insulation member and a straight-line distance between the output terminal and the core, the roundabout distance being greater than the straight-line distance between the output terminal and the core.

9. The high voltage transformer as set forth in claim 8, further comprising:

first and second insulating papers covering first and second sections of the secondary coil, respectively, wherein the second insulating paper is disposed between the secondary coil and the insulation member.

10. The high voltage transformer as set forth in claim 9, further comprising:

a heater coil; and a third insulating paper covering the first and second insulating papers, wherein the third insulating paper is disposed between the secondary coil and the heater coil.

11. A high voltage transformer, comprising:

a laminated E core having at least one prong surrounded by a plurality of coils to boost an alternating current voltage, the laminated E core being connected to a potential;

a laminated I core in contact with the at least one prong of the laminated E core;

an output terminal that outputs the voltage boosted by the plurality of coils; and an insulation member vertically positioned and fixed between the output terminal and the laminated E core at a predetermined distance away from the laminated E core wherein the insulation member extends an insulation distance between the output terminal and the laminated E core, the insulation distance being a roundabout distance which is a total sum of a distance extending from the output terminal to a top of the insulation member and a straight-line distance between the output terminal and the laminated E core, the roundabout distance being greater than the straight-line distance between the output terminal and the laminated E core.

* * * * *